United States Patent [19]

Rait

[11] 4,075,616

[45] Feb. 21, 1978

[54] DETECTOR FOR ALARM SYSTEM

[76] Inventor: Joseph M. Rait, 1100 Amherst St., Buffalo, N.Y. 14216

[21] Appl. No.: 630,998

[22] Filed: Nov. 12, 1975

[51] Int. Cl.[2] ..... G08B 13/10

[52] U.S. Cl. ..... 340/276; 340/272; 200/85 R

[58] Field of Search ..... 340/272, 275, 276, 280, 340/282, 420; 200/85 R, 86 R

[56] References Cited

U.S. PATENT DOCUMENTS

| | | | |
|---|---|---|---|
| 2,437,969 | 3/1948 | Paul | 200/86 R |
| 2,843,694 | 7/1958 | Bertaux | 200/86 R |
| 3,699,398 | 10/1972 | Newmeyer | 340/272 X |
| 3,748,373 | 7/1973 | Remy | 340/272 X |
| 3,778,804 | 12/1973 | Adair | 340/272 |
| 3,778,805 | 12/1973 | Gould | 340/272 |

*Primary Examiner*—Alvin H. Waring
*Attorney, Agent, or Firm*—E. Herbert Liss

[57] ABSTRACT

Sensing devices responsive to changes in the physical condition of the area in which they are located are disposed in elongate, flexible carriers to form a detecting unit which can be arranged in a tortuous, undulating array to cover an undefined area of any shape desired with a detecting density of any chosen value. The detecting unit can assume various forms including that of a pair of conducting elements disposed within an insulating tube in opposed relation positioned to complete the continuity of a switching circuit when the tube is flexed to cause engagement of the conductors. Another embodiment comprises a plurality of braided strands of insulating material extending lengthwise within an insulating carrier cable sheath. A pair of conductors is included in the braiding in a spiral disposition with each conductor being disposed along the entire length in opposed relation to the other conductor. Another embodiment includes a closed tubular element filled with an inelastic fluid having a servomechanism at one end to actuate a switching device for an electric alarm circuit in response to a change in liquid level. A modification of this embodiment would include a light responsive element in lieu of a servomechanism of a sensitivity so as to respond to a change in light transmission due to the interference of the liquid when the liquid level moves to a position which interferes with the light transmission source or the ambient light.

4 Claims, 7 Drawing Figures

DETECTOR FOR ALARM SYSTEM

BACKGROUND OF THE INVENTION

This invention relates to detecting units and in particular to remotely disposed detecting units for alarm systems.

A number of different detecting units responsive to pressure change, temperature change or presence of smoke for burglar alarm systems, fire alarm systems and smoke detecting alarms have been provided in the prior art for remotely controlling the actuation of an electrical device or alarm. Examples of U. S. patents illustrating such detecting units are those of:

U.S. Pat. No. 2,683,784, Rector, July 13, 1954
U.S. Pat. No. 3,125,739 Deibel et al., Mar. 17, 1964
U.S. Pat. No. 3,437,973, Mabbett, Apr. 8, 1969
U.S. Pat. No. 3,668,337, Sinclair, June 6, 1972.

Rector discloses a burglar alarm mat having a base member with a leaf spring supporting arm above the base member, a pair of contacts and a plunger to bring the contacts into engagement wherein the elongate, flexible supported arm actuates a trigger to release the plunger causing the contacts to engage, to thereby set off an alarm.

Deibel et al. discloses a contactor wherein a sheet of fibrous material separates a pair of conductive plates which operate to close a circuit through the fibrous material when the plates and fibrous material are compressed.

Mabbett discloses an electric switch comprising a matlike element having a first substrate member of interleafed fingers forming contact elements and a contact bridging element formed on the surface of a second substrate member. When pressure is applied to place the bridging element into contact with the interleafed fingers an electric circuit is completed.

Sinclair provides a matrix switch with orthogonally arranged flat conductor cables spaced apart by resilient elements of greater height than the height of the conductors so that when a force is applied to the upper set of conductors the switch is actuated into contact with the lower conductors at each intersection to complete a circuit.

A number of prior art systems utilize pre-formed mats with conducting elements arranged in matrix patterns actuated by pressure. A disadvantage of these systems resides in the limitation on their shape and extent. The conductors are fixed within a preformed geometric pattern which cannot conform to an area of any given geometric shape or size. Another disadvantage of the prior art systems is that they are limited in response to only a single form of physical change as, for example, pressure or if so desired a thermal change, but not both. The devices are not inherently fail safe. Electrical leads connecting them to the electric device to be operated are required and in the case of a burglar alarm, for example, these leads can be cut, disabling the alarm, or they can become inadvertently broken.

In burglar alarm systems it is desirable to cover as much open area as possible and to dispose the sensing elements in unpredictable patterns. It is also desirable to have high density detection nearer doors and windows and sensing means near cabinets which appear to contain valuables. It is also necessary in fire detection systems as well as in burglar alarm systems to have fail safe detection units which will energize the system when the wires are cut or inadvertently broken.

SUMMARY OF THE INVENTION

The present invention contemplates an improved detecting unit eliminating disadvantages of the prior art systems in a novel, economical and simple manner. The sensing element is arranged on or with a cable-like carrier and itself serves as a transmission line. It can be obscurely strung through walls, around moldings or under moldings. The alarm is versatile in that it can be used for smoke detection, fire detection or as a burglar alarm. An alarm circuit box is provided which includes a low voltage circuit for an alarm device such as a bell, light or other suitable audible and visible devices which may be located at the alarm or in a remote location in or out of the building. A low voltage d.c. circuit is also provided for energizing a relay in response to detection of a physical change which activates the alarm system and locks it in until an "On-Off" pushbutton switch is actuated.

A plurality of terminals are provided in circuit with a relay coil for connecting the detecting units thereto. One or more detecting units may be readily secured to the circuit box terminals. At the output terminals various types of switching devices may be employed such as light-dependent switches and fluid actuated switches. The detector unit may itself serve as a switching device. The detecting units may comprise liquid filled flexible tubing whereupon application of pressure on the tubing will raise the liquid level to cause light interference with a light sensitive switch disposed at the end of the tube. Excessive heat may cause the tubing to melt, thereby dropping the liquid level. The light responsive device may be arranged to respond to either lowering or raising of the liquid level. The change in liquid level may actuate a diaphragm type switch where the diaphragm is normally maintained in a balanced condition by the normal condition of the liquid. When pressure is applied to the tube the liquid will rise to actuate the diaphragm which in turn will close contacts to energize the alarm system. If the tube melts due to excessive heat conditions the diaphragm will drop to again close a set of contacts. Similarly a piston can be used or any other suitable mechanical device responsive to a change in liquid level. In another form of the invention the flexible tube may have imbedded in its internal walls a pair of uninsulated conductors disposed in spaced apart, opposed relationship with a portion of the conductor exposed so that pressure applied to the tube will cause closing of the circuit. In another modification of this form the tube may contain braided insulating strands with a pair of uninsulated conductors incorporated among the strands in a spiral path, the strands being disposed in opposed relation along their entire length so that pressure applied from any direction will cause electrical contact resulting in energization of the alarm circuit.

In the light sensitive arrangement smoke can readily be detected because of the change in light transmission due to the existence of smoke. Thermally responsive units may be secured to the terminals for energizing the alarm circuit in response to excessive heat conditions.

The principal object of the present invention is to provide a simple, effective, versatile, improved detecting unit for sensing changes in pressure, temperature or atmospheric conditions and which can be arranged in a randomly selected pattern with the density of detection coverage variable to suit the needs in a particular area.

Other objects and advantages of the invention will be apparent from the following detailed description taken in connection with the accompanying drawings.

DETAILED DESCRIPTION OF THE INVENTION

Figure 1:
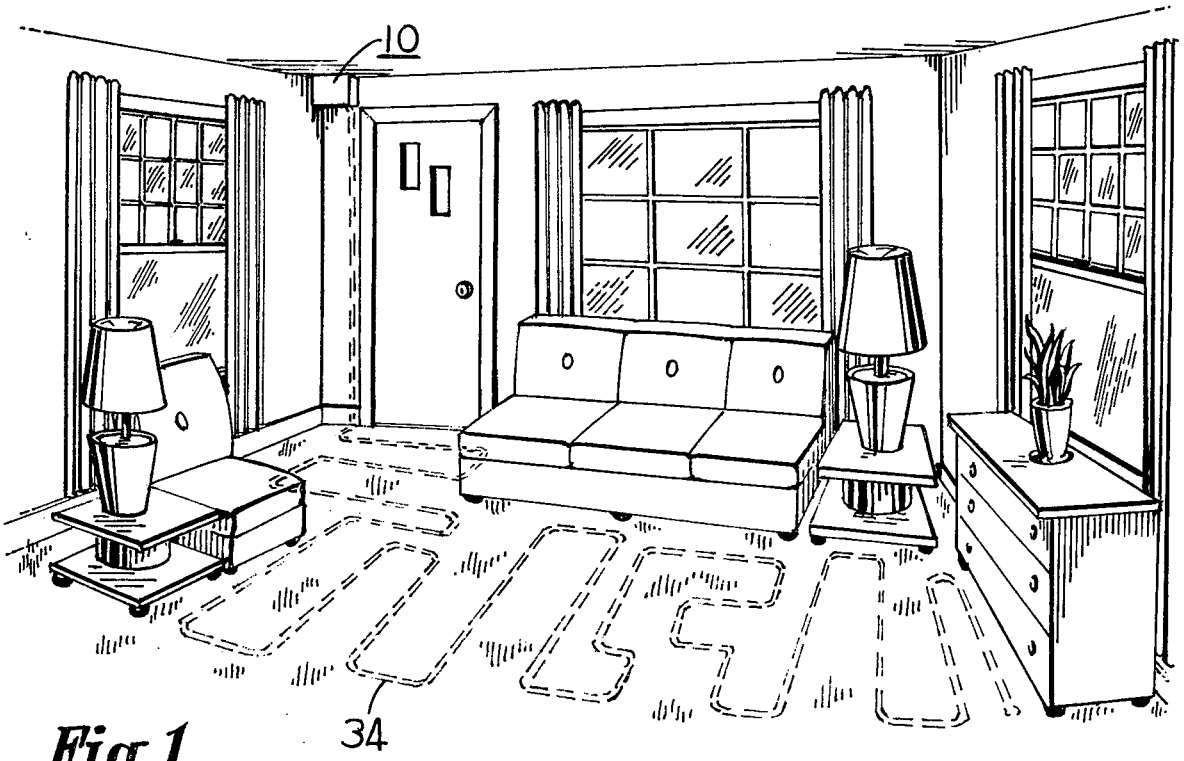
FIG. 1 is a pictorial drawing of an interior of a building having an alarm system utilizing the detecting units of the present invention.

In FIG. 1 there is shown generally an alarm system comprising a circuit box 10 which may be mounted in any suitable convenient location or, if necessary, concealed in any suitable manner in a place not readily accessible to an intruder.

Figure 7:
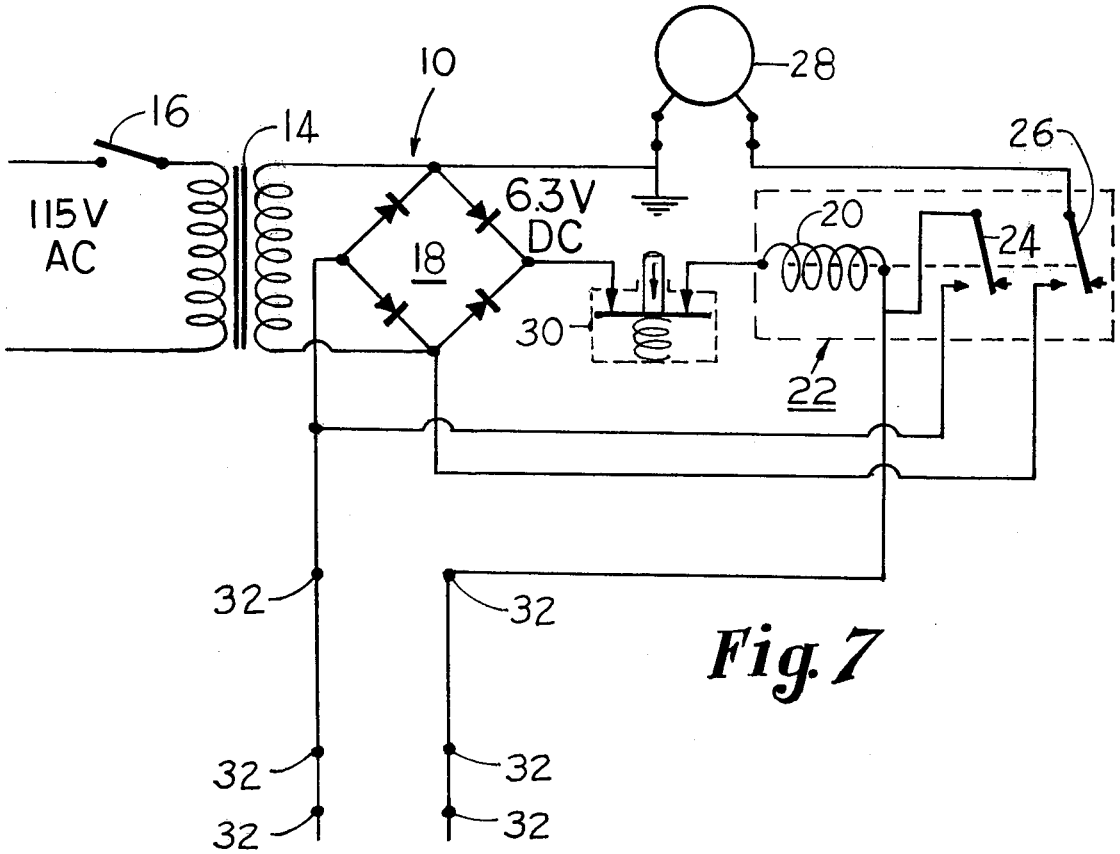
FIG. 7 is a circuit diagram of the alarm system of this invention.

An alarm circuit 12 which may be employed with this invention is illustrated by way of example in FIG. 7. It comprises a transformer 14 adapted to be connected to a voltage source through a main on-off switch 16. The output of the transformer may be connected to a diode bridge rectifier 18 for supplying low voltage d.c. to the coil of a double pole-double throw relay 22 which actuates a pair of normally open-closed when energized contactors 24 and 26 in the usual manner. Contactor 24 is connected in circuit with the relay coil 20 across the output of diode bridge rectifier 18 and serves as a latching switch for the relay coil 20. A bell 28 is provided in circuit with the output of transformer 14 and contactor 26 of relay 22. A normally closed push button switch 30 is connected in series with relay coil 20. Although a bell is shown for purposes of illustration it should be understood of course that in accordance with the broader aspects of the invention, a light, a siren or ay other visible or audible device may be employed. Furthermore such visible or audible device may be connected at the circuit box 10 or at a remote location inside or outside of the building. For example, a light or audible device can be placed on the roof or wired to a protective agency, a police station or a fire station. Any number of alarm elements may be connected in parallel if the circuit parameters are properly selected.

A plurality of external terminals 32 may be provided for connecting detecting units 34 to the circuit box 10. Diverse types of switching mechanisms may be used for energizing relay coil 20 in response to a physical change in the sensor of the detecting unit 34 as will hereinafter be described.

When conduction of electrical current is effected across output terminals 32, the relay coil becomes energized thereby closing contactors 24 and 26 to latch the relay in energized position and to energize the bell 28 or other alarm device or devices. The alarm continues to be activated until switch 30 is opened to deenergize relay coil 20, causing contactor 26 to open.

The detecting units 34 of the invention comprise elongate flexible resilient tubular carriers of insulating material preferably plastic or elastomeric material which can be arranged in a tortuous and undulating path covering an unlimited and undefined area as shown in FIG. 1.

Figure 2:
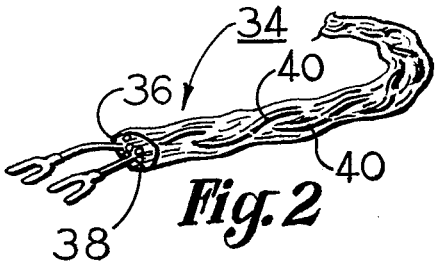
FIG. 2 is a partial perspective view illustrating a preferred embodiment of the invention.
Figure 3:
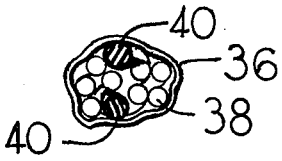
FIg. 3 is a lateral cross section of the FIG. 2 embodiment.

The embodiment shown in FIGS. 2 and 3 illustrates a detecting unit comprising a carrier 36 in the form of a flexible, tubular, resilient sheath of undefined length. The carrier encloses a plurality of braided strands of plastic 38 extending lengthwise of the carrier to form a braided element. A pair of conducting wire strands 40 constituting sensing means are incorporated in the braided element. These wire strands 40 are arranged in a spiral path extending lengthwise of the braided cable and are disposed in spaced apart opposed relationship substantially 180° apart at each point along their length. They are disposed adjacent the periphery of the braided element. The insulating strands fill substantially all of the intersticial space within the carrier around and between the conducting strands 40. They retain the conductors in spaced apart position until pressure is applied. Pressure applied to the cable in any direction causes the conducting wire strands 40 to contact each other to provide an electrical conducting path across terminals 32 thereby energizing the alarm circuit. It should be noted that excessive heat above the melting point of the plastic strands 38 but below the melting point of the conducting wire strands 40 will cause the opposed conducting wire strands 40 to engage and to energize the alarm circuit.

Figure 5:
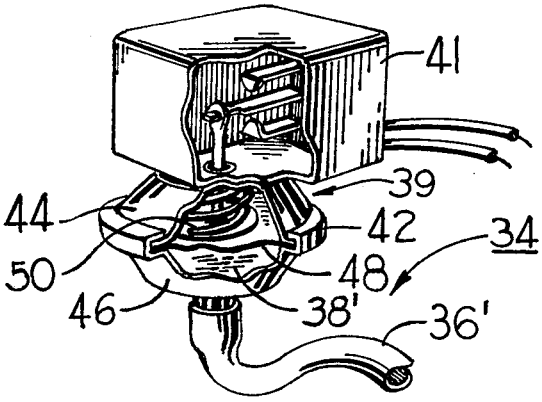
FIG. 5 is an elevational view of another modification employing a fluid type detecting unit with mechanical switching means.
Figure 4:
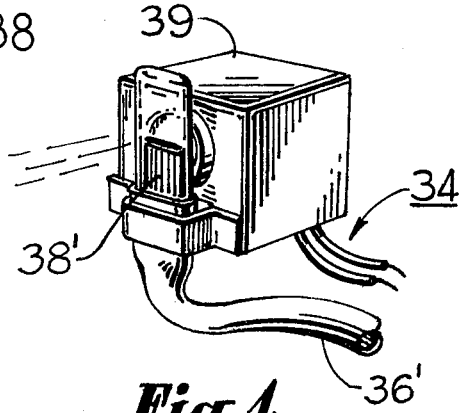
FIG. 4 is a partial perspective view illustrating an embodiment of the invention employing a fluid type detecting unit with a light sensitive response.

The embodiments of the invention shown in FIGS. 4 and 5 illustrate a detecting unit comprising a carrier 36' of elongate, flexible, resilient, tubular plastic material sealed at one end. At its other end circuit control means are provided. The sensing means is provided by fluid 38' filling the tubular carrier 36'. The fluid may be either a liquid or gas.

As shown in FIG. 4, the circuit control means may consist of one of many well known light responsive switching circuits 39 which may utilize a light dependent resistor (LDR) or other suitable light sensitive element properly adjusted or constructed to be insensitive to changes in ambient light but sensitive to a change in intensity of light impinging thereon. When the liquid level rises due to pressure on the carrier 36' it obscures the light impinging on the light responsive switching means 39 to cause closing of the switching circuit. Various known circuit arrangements such as a Wheatstone bridge circuit balanced by an LDR or transistor switching circuit are employed to control energization in this type of device. Such a circuit is described in U. S. Pat. No. 3,842,403 to Konopka issued Oct. 15, 1974. Such an arrangement could also operate as a smoke detector. Smoke in the area of the light sensor would obscure the light resulting in circuit energization.

The modification illustrated in FIG. 5 employs a diaphragm type servomechanism for actuating a switch 39'. A housing 42 having a pair of chambers 44 and 46 are isolated from each other by a movable wall or diaphragm 48. The diaphragm 48 is retained in a balanced position by the fluid 38' in chamber 46 and a spring 50 in chamber 44. Pressure on the carrier 36' causes the fluid to move the diaphragm. A rod connected to the diaphragm 48 is engagable with a contactor 41 to cause closing thereof. If a double throw contactor is employed the spring will cause the contactor to close if the fluid 38' escapes from any cause, such as cutting the tube 36' or melting thereof by excessive heat. It will of course be understood that movable wall 48 could be in the form of a piston as well as a diaphragm.

Figure 6:
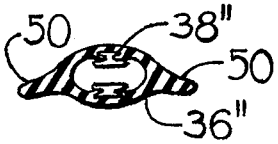
FIG. 6 is a cross sectional view illustrating yet another embodiment of the invention employing uninsulated wires within a tubular element.

In another embodiment of the invention illustrated in FIG. 6 the carrier comprises an elongate resilient flexible plastic tube 36'' of an eliptical or oval shape with side wings 50. The side wings 50 and oval or eliptical shape assure correct orientation of the carrier. Sensing means in the form of uninsulated conductor 38'' may protrude from the internal walls and when pressure is applied to the carrier 36'' the uninsulated conductors make contact to close the relay circuit and energize the alarm. When excessive heat conditions occur the plastic may melt and the conductors can make contact to energize the alarm.

A unique, novel yet simple detecting unit usable in diverse alarm systems such as burglar alarms, fire alarms, doorway announcers, door openers, etc. has been provided. The detecting unit in accordance with the broader aspects of the invention could be laid across the floor of a garage to energize a light. It could be strung across a street or highway to serve as a counting device. It is versatile in that a single unit can serve as both an excessive heat or fire detector and a burglar alarm. Certain of the embodiments of the detecting units are fail safe in that cutting or inadvertent breaking of the unit may cause the alarm to be energized. A major advantage of the unique detecting unit of the invention is the versatility in arranging the sensing elements wherever desired and in whatever shape desired with whatever density is required. The detecting unit can be packaged on a spool of any length and as long a piece as is necessary can be incorporated in the system. It can be cut to length during installation. The multiple terminal arrangement on the alarm circuit box permits lengths of separate detecting units to be attached if necessary.

Although certain specific embodiments of the invention have been shown and described for the purpose of illustration it will of course be understood that in accordance with the broader aspects of the invention various modifications and embodiments may be made which come within the scope of the invention. Other and different alarm circuitry may be employed. The alarm circuitry may be of greater or less sophistication. The detector units may be used to sense activity in any area for the different purposes than alarms and other and different devices may be employed in conjunction with the detecting units of this invention. Therefore, it is to be understood that the invention is not limited to the specific arrangements shown but in its broadest aspects it includes all equivalent embodiments and modifications which come within the scope of the invention.

What is claimed is:

1. A switching device comprising an elongate flexible cable-like tubular carrier of insulating material of undefined length, sensing means occupying the full volume of said carrier and extending longitudinally substantially the entire length thereof, said sensing means comprising a fibrous, flexible, resilient mass of insulating material having a pair of uninsulated conducting wires spirally intertwined longitudinally therethrough in opposed spaced apart relationship, each point of one of said pair of conducting wire being disposed opposite a point on the other of said pair of conducting wires, the insulating material separating and insulating said conducting wires one from the other, said mass of insulating material being permeable to permit said conducting wires to penetrate said mass to thereby engage each other in response to an applied force transversely of the carrier in any direction and at any point, said mass being resilient for effecting restoration of said spaced relationship when the applied force is removed.

2. A switching device according to claim 1 wherein said mass of material comprises a plurality of strands of flexible, resilient insulating material extending lengthwise through said carrier substantially filling the interstitial spaces around and between said conductors.

3. A switching device according to claim 1 wherein said mass of insulating material comprises a plurality of strands of insulating material braided together to form a unitary braided element.

4. A switching device according to claim 1 wherein said pair of conducting wires are incorporated among the braided strands of said braided element.

* * * * *